US010358198B2

(12) United States Patent
Polak

(10) Patent No.: US 10,358,198 B2
(45) Date of Patent: Jul. 23, 2019

(54) SNORKEL

(71) Applicant: Cheinan Polak, Ein Ya'Akov (IL)

(72) Inventor: Cheinan Polak, Ein Ya'Akov (IL)

( * ) Notice: Subject to any disclaimer, the term of this patent is extended or adjusted under 35 U.S.C. 154(b) by 367 days.

(21) Appl. No.: 15/356,589

(22) Filed: Nov. 20, 2016

(65) Prior Publication Data

US 2017/0144738 A1 May 25, 2017

Related U.S. Application Data

(60) Provisional application No. 62/258,474, filed on Nov. 22, 2015.

(51) Int. Cl.

| | |
|---|---|
| ***B63C 11/16*** | (2006.01) |
| ***B63C 11/20*** | (2006.01) |
| *B63C 11/12* | (2006.01) |

(52) U.S. Cl.

CPC ..... *B63C 11/207* (2013.01); *B63C 11/16* (2013.01); *B63C 2011/128* (2013.01)

(58) Field of Classification Search

CPC ..... A61M 16/06; A61M 16/0875; A61M 16/0816; A61M 16/08; A61M 16/0605; A61M 16/0683; A61M 16/208; B63C 11/207; B63C 2011/128; B63C 11/16; B63C 11/205; B63C 11/2245

USPC ..... 128/201.11

See application file for complete search history.

(56) References Cited

U.S. PATENT DOCUMENTS

| | | | | |
|---|---|---|---|---|
| 2,780,224 A * | 2/1957 | Wallace | B63C 11/16 128/201.11 |
| 5,622,165 A * | 4/1997 | Huang | B63C 11/207 128/201.11 |
| 2006/0037607 A1 | 2/2006 | Trujillo | |
| 2006/0102176 A1 | 5/2006 | Junck | |

FOREIGN PATENT DOCUMENTS

| | | |
|---|---|---|
| JP | H10 129587 | 5/1998 |

* cited by examiner

*Primary Examiner* — Jason E Flick

(74) *Attorney, Agent, or Firm* — Alphapatent Associates, Ltd; Daniel J. Swirsky

(57) ABSTRACT

A snorkel, including at least one tube, for allowing a user to flow air between a top opening disposed above the water level, and a bottom opening ending with a breathing piece disposed below the water level, a float fixed to the at least one tube, for maintaining the top opening above the water level, while being attached to the user and as well while being separated therefrom, and a valve assembly, disposed adjacent to the breathing piece and communicating therewith, for not allowing water to enter the breathing piece, thereby allowing the user to separate himself from the snorkel, and further to safely attach himself thereto.

7 Claims, 6 Drawing Sheets

STEP 3

STEP 1

FIG 2 - STEP 2

FIG 3 - STEP 3

SNORKEL

CROSS-REFERENCE TO RELATED APPLICATIONS

This application claims the benefit of priority from U.S. Provisional Patent Application No. 62/258,474, filed Nov. 22, 2015, the disclosure of which is incorporated herein by reference.

TECHNICAL FIELD

The invention relates to the field of snorkels. More particularly, the invention relates to a snorkel having safe connecting means.

BACKGROUND

A prior art swimming snorkel includes a tube 28 typically about 30 centimeters long, and a mouthpiece. The mouthpiece is intended to be disposed below the water level, and the tube's inlet is intended to be disposed above the water level.

However, once water enters the tube, the tube is dangerous, and it is the responsibility of the user to release the water out of the tube.

U.S. Pat. No. 2,780,224 describes a snorkel having a float. However, the snorkel there must have a long tube, and thus the above problem is even increased.

The invention provides a solution to the above-mentioned and other problems of the prior art.

SUMMARY

In one aspect, the invention is directed to a snorkel, including:

- at least one tube, for allowing a user to flow air between a top opening disposed above the water level, and a bottom opening ending with a breathing piece disposed below the water level;
- a float fixed to the at least one tube, for maintaining the top opening above the water level, while being attached to the user and as well while being separated therefrom;
- separable attaching means, for allowing the user to attach to the at least one tube and to the float, and to separate therefrom;
- a valve assembly, disposed adjacent to the breathing piece and communicating therewith, for not allowing water to enter the breathing piece, thereby allowing the user to separate himself from the snorkel, and further to safely attach himself thereto.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
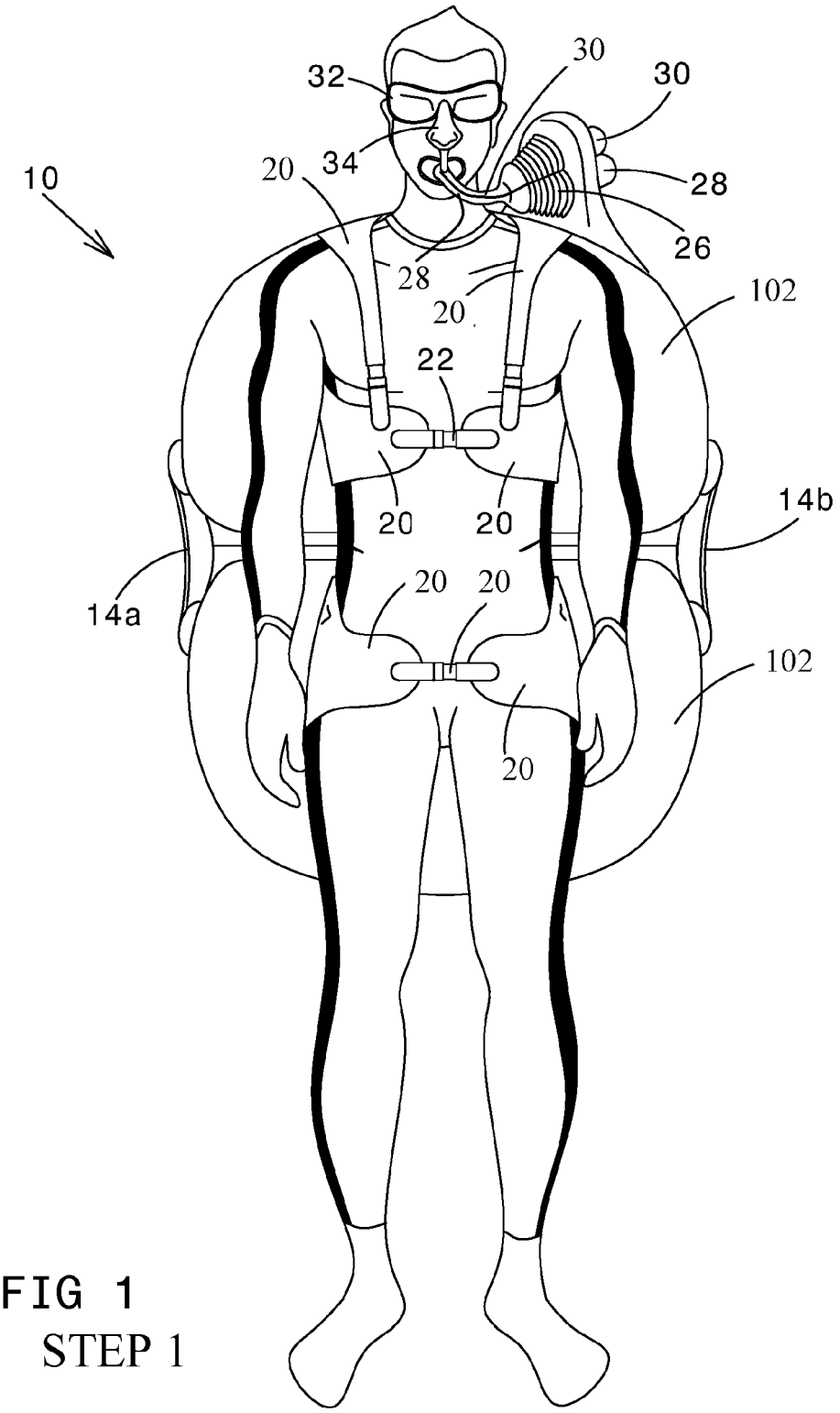
FIG. 1 depicts a snorkel according to one embodiment of the invention, at the first step of use.

FIG. 1 depicts a snorkel according to one embodiment of the invention, at the first step of use.

A snorkel 10 according to one embodiment of the invention, includes, like a prior art snorkel, a tube 28 and a mouthpiece 38.

Unlike prior art snorkels, swimmer's snorkel 10 includes a float 102, and a strap 20 for attaching float 102 to the user's body.

At the first step, the user wears snorkel 10 including float 102, and then starts swimming, such that float 102 floats his body.

Float 102 preferably is sufficiently large for containing sufficient air for floating the entire weight of the user.

Figure 2:
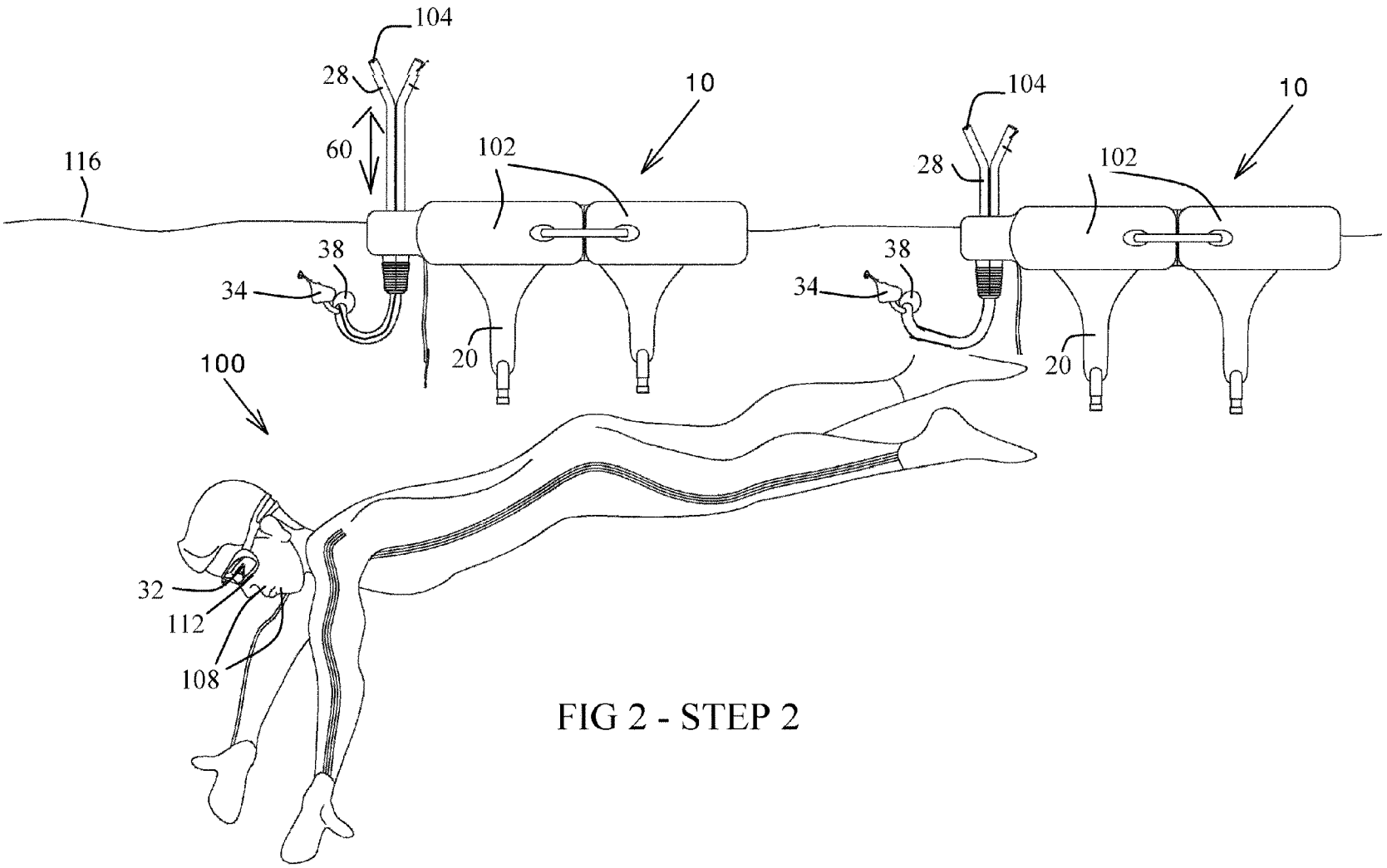
FIG. 2 depicts the snorkel of FIG. 1, at the second step of use, as being not attached to the user.

FIG. 2 depicts the snorkel of FIG. 1, at the second step of use, as being not attached to the user.

Thus, float 102 maintains the top opening 104 of tube 28 above the water level 116. Thus, tube 28 is safe in regard to that water cannot enter through top opening 104 while swimming.

Float 102, as having a known height in relation to water level 116, may function as a height reference for determining the height of top opening 104 above water level 116. In regard to this, FIG. 2 shows a left snorkel 10 having a high top opening 104, and a left snorkel 10 having a lower top opening 104. The difference between them is that tube 28 has been moved in relation to float 102 via moving means, being adjusting means 60.

At the second step, depicted in FIG. 2, the user may separate himself from snorkel 10, while yet wearing goggles 32.

Float 102 yet maintains top opening 104 of tube 28 above the water level 116 at this state also. Thus, tube 28 is safe in regard to that water cannot enter through top opening 104 at any state.

Figure 3:
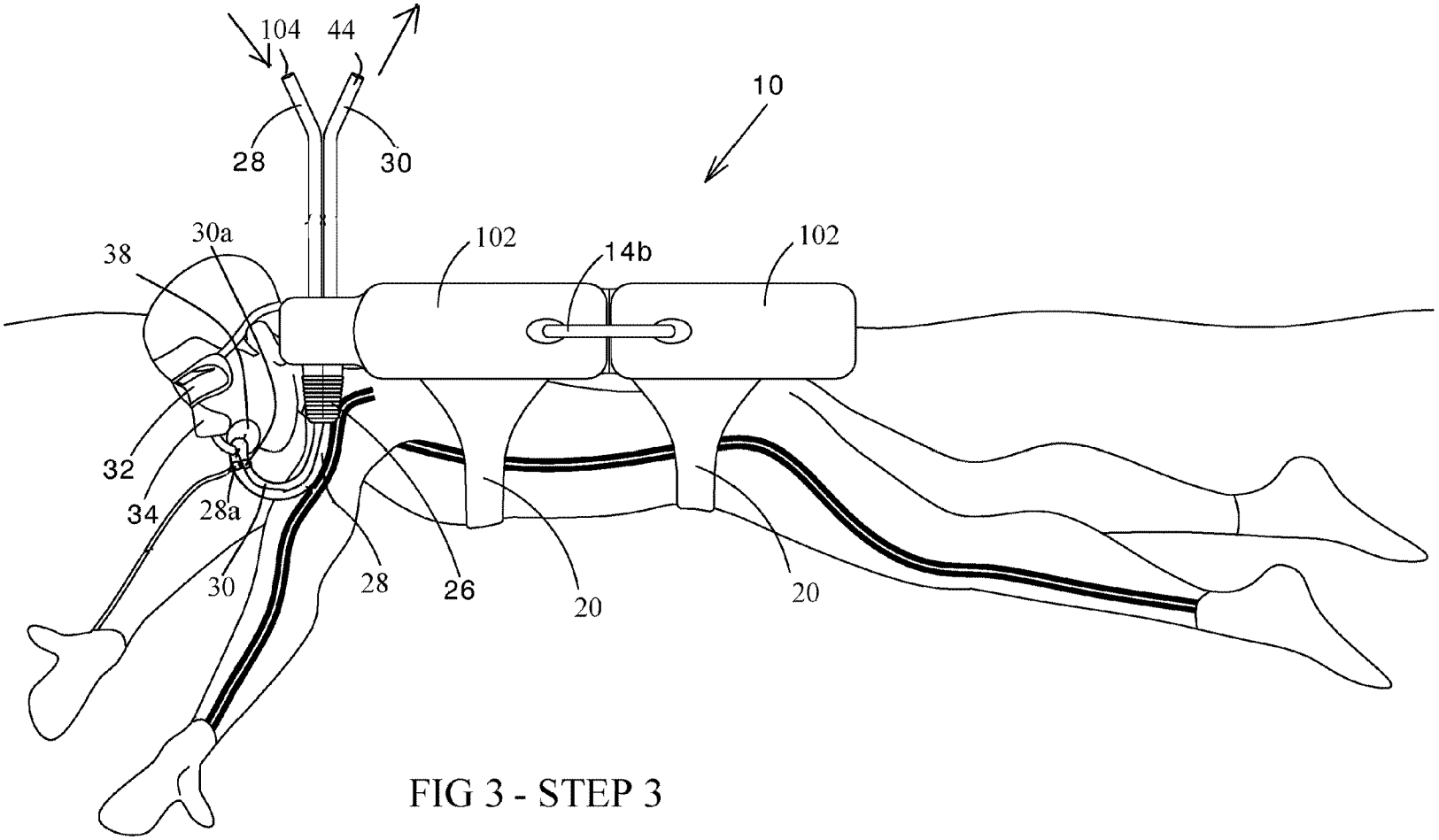
FIG. 3 depicts the snorkel of FIG. 1 at the third step of use, as being attached to the user.

FIG. 3 depicts the snorkel of FIG. 1 at the third step of use, as being attached to the user.

The user attaches snorkel 10 to his body by strap 20.

The user further attaches snorkel 10 by connecting mouthpiece 38 to the mouth of the user, and nose piece 34 to the nose by connecting nose piece 34 to goggles 32.

The user, even though being at the second step, shown in FIG. 2, in which the user is definitely separated from air, is capable of safe connecting mouthpiece 38 to the mouth; and is further capable of safely connecting nose piece 34 to the nose. This, since water cannot enter mouthpiece 38 or nose piece 34, as explained following.

Figure 4:
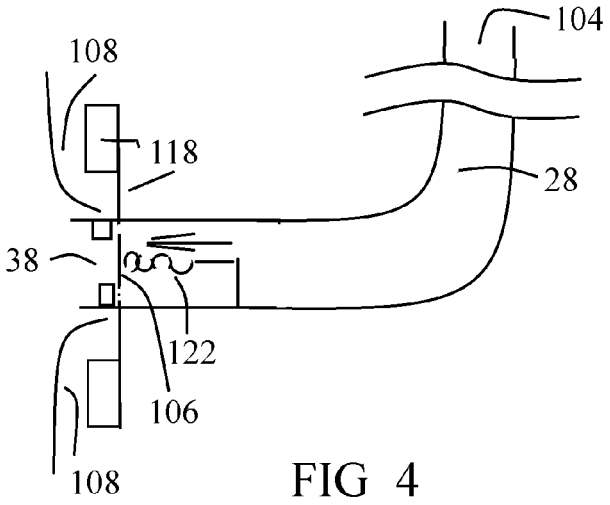
FIG. 4 schematically describes the tube and the mouthpiece of FIG. 1 according to one embodiment.

FIG. 4 schematically describes the tube and the mouthpiece of FIG. 1 according to one embodiment.

Tube 28 is full of air, since float 102 floats the top opening 104 of tube 28 and the top opening 44 of tube 30, both above the water level 116 at any state, thus tube 28 is safe in regard that water cannot enter through top openings 104 and 44.

Mouthpiece 38 further includes a valve assembly 50, disposed for not allowing water to enter mouthpiece 38, indicated in FIG. 3.

According to a first embodiment, valve assembly 50 constitutes a valve 106 being openable only by being pressed, through a lever 118, by the mouth's surrounding surface 108 (indicated also in FIG. 1).

Figure 5:
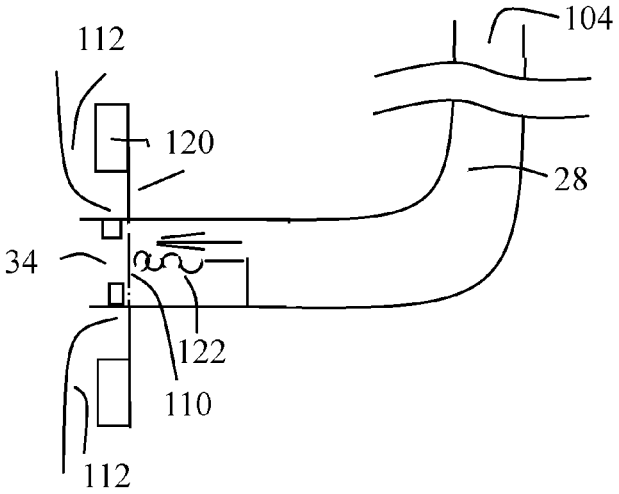
FIG. 5 schematically describes the tube and the nose piece of FIG. 1 according to the embodiment of FIG. 4.

FIG. 5 schematically describes the tube and the nose piece of FIG. 1 according to the embodiment of FIG. 4.

Similarly, according to this embodiment, nose piece 34 may include a valve 110, being openable only by being pressed, through a lever 120, by the nose's surrounding surface 112 (indicated also in FIG. 1).

Figure 6:
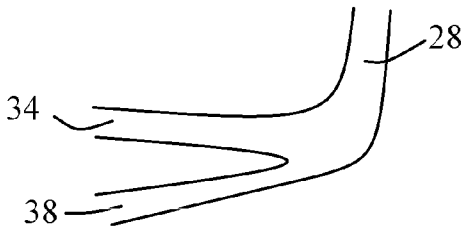
FIG. 6 schematically describes the tube, the mouthpiece, and the nose piece of FIG. 1.

FIG. 6 schematically describes the tube, the mouthpiece, and the nose piece of FIG. 1.

Mouthpiece 38 and nose piece 34 both communicate with tube 28.

Figure 7:
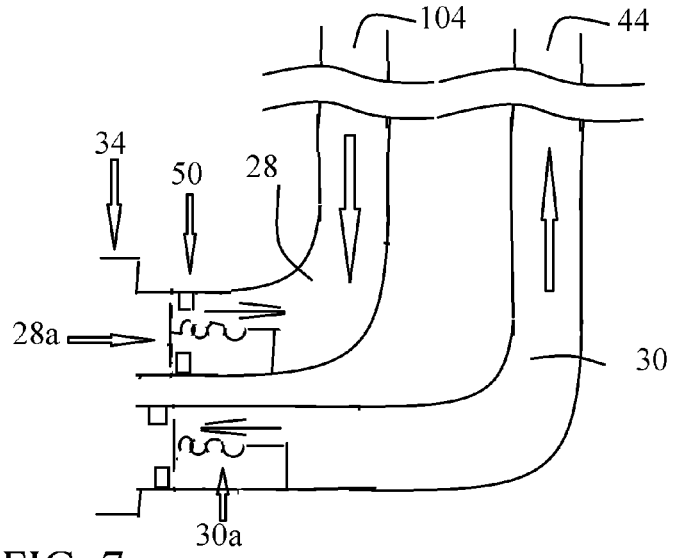
FIG. 7 depicts the valve assembly according to another embodiment.

FIG. 7 depicts the valve assembly according to another embodiment.

According to another embodiment, valve assembly 50 constitutes separation to tubes 28 and 30; a valve 28*a* in tube 28 for allowing inhaling only; and a valve 30*a* in tube 30, for allowing exhaling only. Thus, tube 28 allows inhaling only, and tube 30 allows exhaling only.

Both of valves 28*a* and 30*a* are normally closed. For example, each includes a spring pressing a plate to close the opening of the valve.

Thus, once the user separates himself from snorkel 10, valves 28*a* and 30*a* avoid entrance of water into tubes 28 and 30 respectively.

Figure 8:
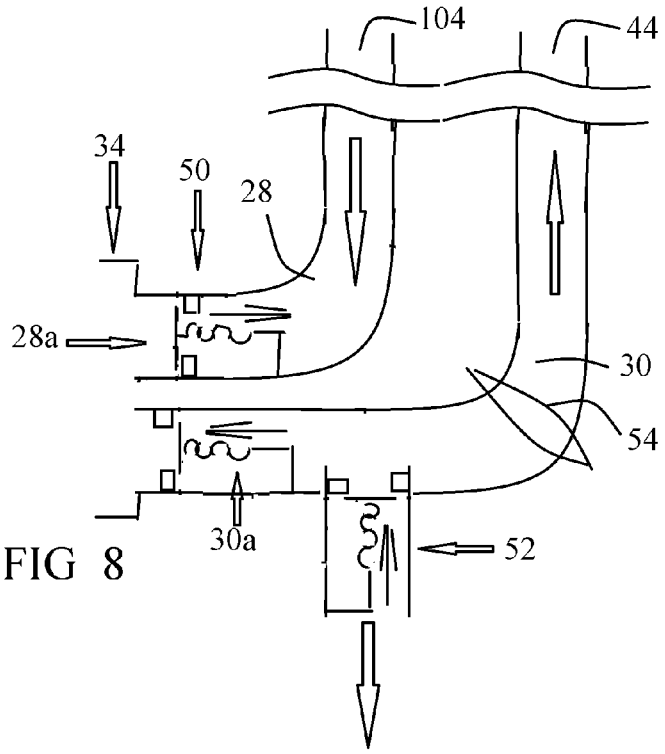
FIG. 8 depicts the valve assembly of FIG. 7 including an additional valve.

FIG. 8 depicts the valve assembly of FIG. 7 including an additional valve.

Valve assembly 50 may further include a water exhaust valve 52 within exhaling tube 30.

Exhaling valve 30*a* is disposed between mouthpiece 34 and water exhaust valve 52, thereby said exhaling valve 30*a* avoids water inhaling during water exhausting through valve 52.

Exhaling tube 30 may have a squeezable region 54, for manually blocking it, for not allowing the exhausted water to go all along tube 30, but rather to be directed to exhaust valve 52.

Figure 9:
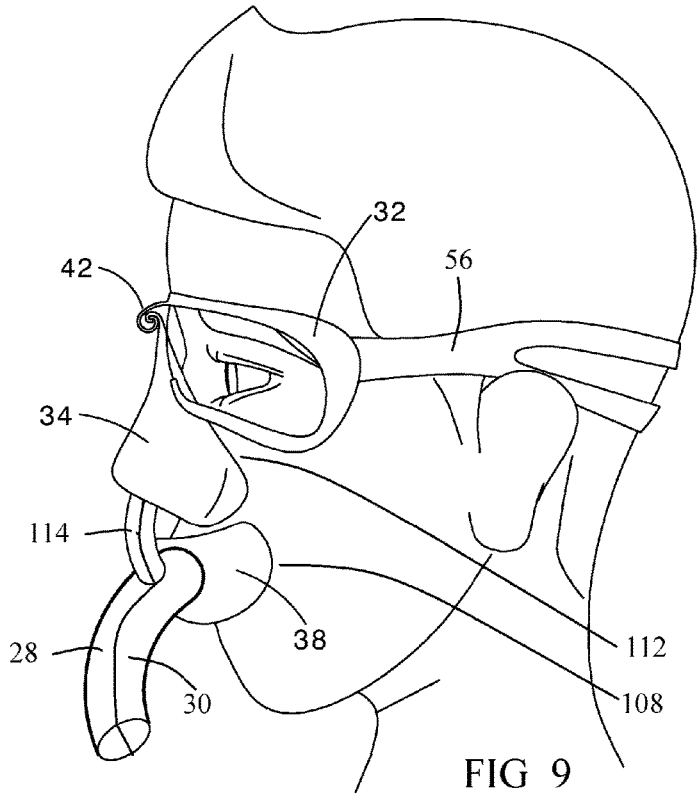
FIG. 9 is a perspective view of the tube, the mouthpiece, and the nose piece of FIG. 1.

FIG. 9 is a perspective view of the tube, the mouthpiece, and the nose piece of FIG. 1.

Mouthpiece 38 and nose piece 34 may communicate with tube 28 through an internal pipe 114.

Figure 10:
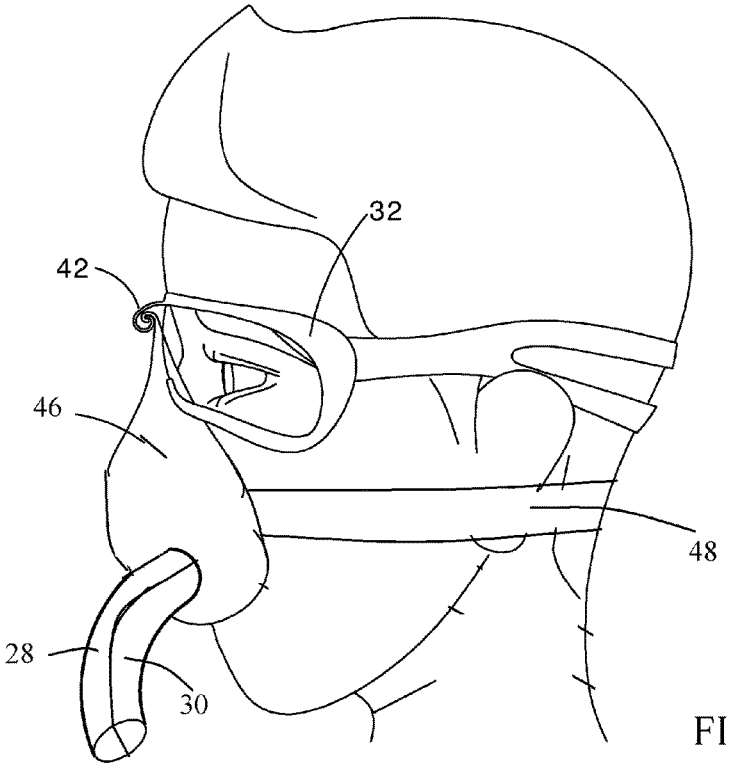
FIG. 10 is a perspective view of the tube, the mouthpiece, and the nose piece of FIG. 1 according to another embodiment.

FIG. 10 is a perspective view of the tube, the mouthpiece, and the nose piece of FIG. 1 according to another embodiment.

According to another embodiment, mouthpiece 38 and nose piece 34 constitute an integrated shared piece 46.

Nose piece 34 or mouth and nose integrated piece 46 may physically be attachable to goggles 32, being yet worn at the second step.

According to another embodiment, nose piece 34 or mouth and nose integrated piece 46 may be attachable to the user's head by a strap 48.

Thus, in one aspect, the invention is directed to a snorkel (10), including:

at least one tube (28), for allowing a user to flow air between a top opening (104) disposed above the water level (116), and a bottom opening (34, 38) ending with a breathing piece (38, 34, 46) disposed below the water level (116);

a float (102) fixed to the at least one tube (28), for maintaining the top opening (104) above the water level (116), while being attached to the user and as well while being separated therefrom;

separable attaching means (20, 42, 52), for allowing the user to attach to the at least one tube (28) and to the float (102), and to separate therefrom;

a valve assembly (50), disposed adjacent to the breathing piece (38, 34, 46) and communicating therewith, for not allowing water to enter the breathing piece (38, 34, 46), thereby allowing the user to separate himself from the snorkel (10), and further to safely attach himself thereto.

The at least one tube (28) may constitute a first (28) and a second tube (30), and the valve assembly (50) may include:

a first valve (28*a*) disposed within the first tube (28), and being characterized in being normally closed and in allowing inhaling only; and a second valve (30*a*) disposed within the second tube (30), and being characterized in being normally closed, and in allowing exhaling only, and wherein each of the first (28*a*) and second (30*a*) valves communicates separately with the breathing piece (38, 34, 46), thereby the first (28*a*) and second (30*a*) valves allow inhaling and exhaling, and are closed while being separated from the user.

The snorkel (10) may further include:

a third valve (52) disposed within the second tube (30), wherein the second valve (30*a*) is disposed between the breathing piece (38, 34, 46) and the third valve (52), and wherein the third valve (52) is characterized in being normally closed, and in allowing exhaling only, and in forming an exhaust opening, thereby the second valve (30*a*) avoids water inhaling during water exhausting through the third valve (52).

The separable attaching means (20, 42, 48) may constitute a first strap (20), for separably attaching the float (102) to the body of the user.

The separable attaching means (20, 42, 48) may constitute a fastener (42), for fastening the breathing piece (38, 34, 46) to goggles (32), thereby utilizing attaching means (56) of the goggles (32) for attaching the breathing piece (38, 34, 46) to the user, and thereby the separation of the user from the snorkel (10) does not separate the user from the goggles (32).

The separable attaching means (20, 42, 48) may constitute a second strap (48), for attaching the breathing piece (38, 34, 46) to the user, thereby the separation of the user from the snorkel (10) does not separate the user from the goggles (32).

The snorkel (10) may further include length adjusting means (60), for adjusting the distance of the top opening (104) from the float (102), thereby the adjusting means (60) allows adjusting the distance of the top opening (104) from the water level (116).

The float (102) may be sufficiently large for containing sufficient air for floating an entire weight of the user.

The breathing piece (38, 34, 46) may constitute:

a mouthpiece (34), a nose piece (38), a mouth and nose integrated piece (46).

The valve assembly (50) may include a lever (120, 118), for opening a fourth valve (110, 106) by a face surface (112, 108) of the user pressing the lever (120, 118), thereby the valve (106) is openable for allowing breathing, only upon being attached to the face surface (112, 108).

In the figures and/or description herein, the following reference numerals (Reference Signs List) have been mentioned:

numeral 10 denotes the swimming snorkel according to one embodiment of the invention;

numerals 14*a* and 14*b* denotes straps for adjusting distance between two floats;

numeral 20 denotes the strap for embracing the user's body, for attaching the float thereto;

numeral 26 denotes a region of the tube for allowing bending and extending of the tube;

numeral 28 denotes the air inhaling tube;

numeral 28*a* denotes a valve for allowing inhaling only;

numeral 30 denotes an air exhaling tube;

numeral 30*a* denotes a valve for allowing exhaling only;

numeral 32 denotes goggles;

numeral 34 denotes the nose piece;

numeral 38 denotes the mouthpiece;

numeral 42 denotes a fastener, for fastening the nose piece to the goggles;

numeral 44 denotes the top opening of the exhaling tube;

numeral 46 denotes a mouth and nose integrated piece;

numeral 48 denotes a strap;

numeral 52 denotes a water exhaust valve;

numeral 56 denotes a strap, functioning as fastening means for the goggles;

numeral 100 denotes the user;

numeral 102 denotes the float for floating the tube at any time, and for floating the user while the user desires;

numeral 104 denotes the top opening of the tube;

numeral 106 denotes a valve, for allowing breathing by the mouth;

numeral 108 denotes the mouth's surrounding surface, within the face surface of the user;

numeral 110 denotes a valve, for allowing breathing by the nose;

numeral 112 denotes the nose's surrounding surface, within the face surface of the user;

numeral 114 denotes an internal pipe, for communicating both the mouthpiece and the nose piece with the tube;

numeral 116 denotes the water level;

numerals 118 and 120 denote levers, each for opening another valve, by being pressed to the user's face; and numeral 122 denotes a spring of the valve, for normally closing the valve.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A snorkel, comprising:

at least one tube, for allowing a user to flow air between a top opening disposed above a water level, and a bottom opening ending with a breathing piece disposed below the water level;

a float fixed to said at least one tube, for maintaining said top opening above the water level, while being attached to the user and while being separated therefrom;

first separable attaching means, for allowing the user to attach to said at least one tube and to separate therefrom;

second separable attaching means comprising at least a first strap being attached to said float for allowing attaching a body of the user to said float for floating the user's body, and to separate therefrom for ceasing said floating; and a valve assembly, disposed adjacent to said breathing piece and communicating therewith, for not allowing water to enter said breathing piece, thereby allowing the user to separate the user from said snorkel, and further to safely attach the user thereto.

2. A snorkel according to claim 1, wherein said at least one tube comprises a first and a second tube, and wherein said valve assembly comprises:

a first valve disposed within said first tube, and being characterized in being closed and in allowing inhaling only; and a second valve disposed within said second tube, and being characterized in being closed, and in allowing exhaling only, and wherein each of said first and second valves communicates separately with said breathing piece, thereby said first and second valves allow inhaling and exhaling, and are closed while being separated from the user.

3. A snorkel according to claim 2, further comprising:

a third valve disposed within said second tube, wherein said second valve is disposed between said breathing piece and said third valve, and wherein said third valve is characterized in being normally closed, and in allowing exhaling only, and in forming an exhaust opening, thereby said second valve avoids water inhaling during water exhausting through said third valve.

4. A snorkel according to claim 1, wherein said first separable attaching means comprises a fastener, for fastening said breathing piece to goggles, thereby utilizing attaching means of the goggles for attaching said breathing piece to the user, and thereby said separation of the user from said snorkel does not separate the user from the goggles.

5. A snorkel according to claim 1, wherein said first separable attaching means comprises a second strap, for attaching said breathing piece to the user, thereby said separation of the user from said snorkel does not separate the user from goggles.

6. A snorkel according to claim 1, wherein said float is configured for floating an entire weight of the user.

7. A snorkel according to claim 1, wherein said breathing piece comprises at least one member selected from a group consisting of:

a mouthpiece, a nose piece, a mouth and nose integrated piece.

* * * * *